United States Patent [19]

Burkhalter et al.

[11] 4,012,987

[45] Mar. 22, 1977

[54] DUAL COMBUSTION MISSILE SYSTEM

[75] Inventors: John E. Burkhalter; Richard H. Sforzini, both of Auburn, Ala.

[73] Assignee: The United States of America as represented by the Secretary of the Army, Washington, D.C.

[22] Filed: Sept. 3, 1975

[21] Appl. No.: 610,027

[52] U.S. Cl. ..... 89/1.701; 89/1.816

[51] Int. Cl.[2] ..... F41F 3/02; F41F 15/00

[58] Field of Search ..... 89/1.701, 1.7, 1.816

[56] References Cited

UNITED STATES PATENTS

| | | | |
|---|---|---|---|
| 1,395,630 | 11/1921 | Davis | 89/1.701 |
| 3,771,417 | 11/1973 | Schnabele et al. | 89/1.701 |
| 3,800,656 | 4/1974 | Schnabele | 89/1.701 |
| 3,815,469 | 6/1974 | Schubert et al. | 89/1.701 |

*Primary Examiner*—David H. Brown
*Attorney, Agent, or Firm*—Nathan Edelberg; Robert P. Gibson; Harold W. Hilton

[57] ABSTRACT

A missile system with an ogival projectile for operation in a trajectory from a tubular launch tube includes a housing and a slug respectively slidable in the projectile and the housing with the projectile and housing respectively including combustion chambers and pistons enclosing propellant grains therein. The projectile and slug are respectively launched forwardly in the trajectory and rearwardly and the housing is ejected from the projectile responsive to simultaneous ignition of the propellant grains. The piston is ejected from the projectile responsive to continued ignition of the corresponding propellant grain.

4 Claims, 2 Drawing Figures

DUAL COMBUSTION MISSILE SYSTEM

SUMMARY OF THE INVENTION

The momentum imparted to the slug during launch is substantially equal to the combined momentums imparted to the projectile and corresponding piston during launch for minimum launcher recoil. Also a stop in the projectile is ruptured for rocket propulsion thereof responsive to continued propellant grain ignition.

DESCRIPTION OF THE PREFERRED EMBODIMENT

Figure 2:
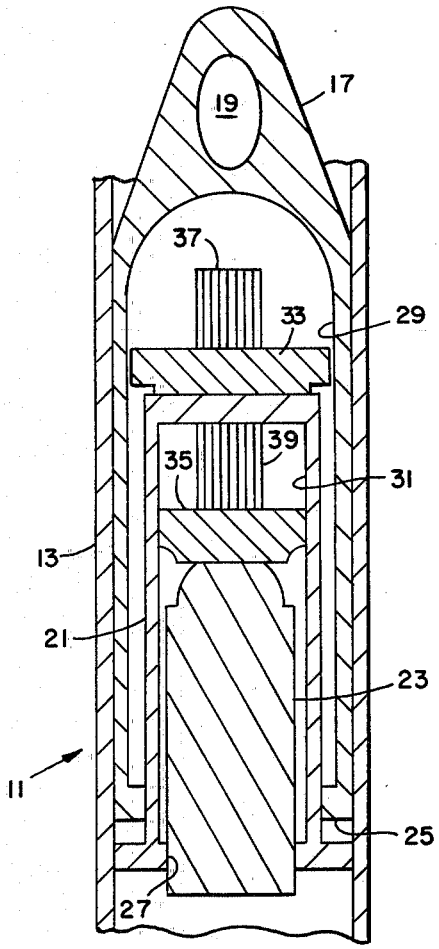
FIG. 2 is a sectional view of the missile enclosed in the launch tube.
Figure 1:
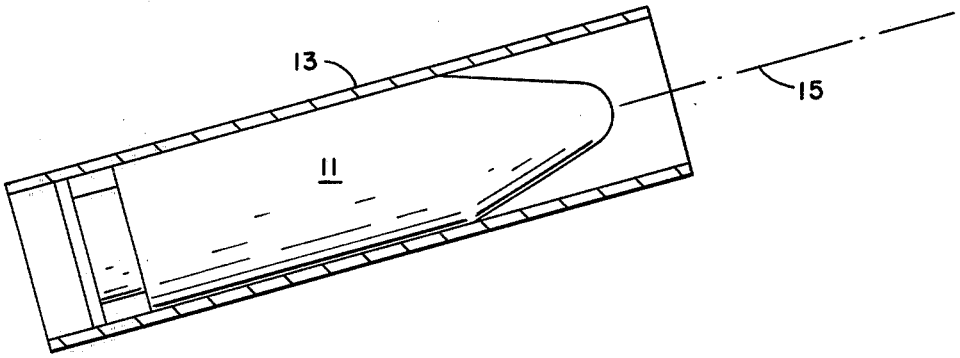
FIG. 1 is a cutaway view of a launch tube with a missile therein disposed for launch in a trajectory.

A missile 11 disposed for launching from a tubular launcher 13 in a trajectory 15 is provided with an ogival projectile including a payload 19, a housing 21 and a slug 23. Projectile 17 and housing 21 include end stops 25 and 27 for respective slidable engagement therein of housing 21 and slug 23. Projectile 17 and housing 21 respectively include dual combustion chambers 29 and 31 with pistons 33 and 35 respectively slidable to retain propellant grains 37 and 39 therein. Housing 21 and slug 23 are in respective engagement with pistons 33 and 35.

Propellant grains 37 and 39 are simultaneously ignited for forward operation of projectile 17 in trajectory 15 and rearward ejection of slug 23 from housing 21 to control recoil of launcher 13. Slug 23 is selected so that the momentum imparted thereto substantially equals the combined momentums imparted to the projectile 17 and piston 33 for minimum recoil of launcher 13. Additionally, housing 21 is ejected from projectile 17 and pistons 33 and 35 are respectively restrained by stops 25 and 27 responsive to the simultaneous ignition. Stop 25 is ruptured and piston 33 is ejected responsive to continued ignition of propellant grain 37 in trajectory 15 for rocket propulsion of projectile 17.

We claim:

1. A missile system comprising:

a tubular launcher for directing a missile in a trajectory; and a missile disposed for enclosure in said launcher and operation in said trajectory and provided with an ogival projectile and a housing with respective rearend stops, a slug and pairs of pistons and propellant grains disposed for simultaneous ignition;

said projectile and housing including respective combustion chambers with said pistons slidable to retain said propellant grains therein, said housing and slug respectively engaging said pistons, said projectile disposed for propulsion in the trajectory and said slug rearwardly responsive to the simultaneous ignition to control recoil of said launcher.

2. A missile system as in claim 1 with the momentum imparted to said slug during launch substantially equal to the combined momentums imparted to said projectile and corresponding piston during launch for minimum recoil of said launcher.

3. A missile system as in claim 1 with said pistons disposed for respective engagement with said stops responsive to the simultaneous ignition.

4. A missile system as in claim 1 with the stop of said projectile disposed to rupture for rocket propulsion thereof responsive to continued ignition of the corresponding propellant grain.

* * * * *